United States Patent [19]

Mandel

[11] Patent Number: 4,848,711

[45] Date of Patent: Jul. 18, 1989

[54] DRUM TRANSPORTING ARRANGEMENT

[76] Inventor: Ronald L. Mandel, 9115 Old State Rd., Evansville, Ind. 47711

[21] Appl. No.: 665,352

[22] Filed: Oct. 26, 1984

[51] Int. Cl.[4] ..... F16M 13/00

[52] U.S. Cl. ..... 248/154; 248/346; 248/310; 248/DIG. 7; 108/55.3

[58] Field of Search ..... 248/154, 346 B, 597, 248/346 E, 310, DIG. 7, 146, 678; 108/55.3, 55.1, 55.5; 206/386, 597, 599, 821, 511

[56] References Cited

U.S. PATENT DOCUMENTS

| | | | |
|---|---|---|---|
| 2,626,078 | 1/1953 | Hutchisson, Jr. et al. | 248/DIG. 7 X |
| 2,673,053 | 3/1954 | Kilian | 248/DIG. 7 X |
| 2,679,996 | 6/1954 | Rowe et al. | 248/DIG. 7 X |
| 3,217,892 | 11/1965 | Goodell | 248/DIG. 7 X |
| 3,802,717 | 4/1974 | Eitreim | 248/154 X |
| 4,046,345 | 9/1977 | Boyd, Sr. | 248/154 |

FOREIGN PATENT DOCUMENTS

| | | | |
|---|---|---|---|
| 2264595 | 7/1971 | Fed. Rep. of Germany | 108/55.3 |
| 821314 | 8/1937 | France | 248/146 |

*Primary Examiner*—Ramon S. Britts
*Assistant Examiner*—Karen J. Chotkowski
*Attorney, Agent, or Firm*—Warren D. Flackbert

[57] ABSTRACT

A drum transporting arrangement characterized as a base or carrier presenting arms extending from a center pedestal and supported by legs and by the center pedestal. The arms are disposed in a pattern permitting ready introduction of the forks of a lift truck in the space between the arms and a floor area. Each arm includes an upstanding slotted projection adapted to receiving a securing band which encircles a drum received on the upper surface of the arms and the center pedestal. The arms each further include an angling portion for drum adaptation.

2 Claims, 1 Drawing Sheet

DRUM TRANSPORTING ARRANGEMENT

As is known, the usage of drums, typically made from metal, containing liquids, such as oil, chemicals and the like, is widespread at manufacturing or other facilities. A primary difficulty in connection with such, for example, is in transporting the drum from a receiving location to a site of use, the latter normally involving an oftentimes awkward and/or manual assisted forklift truck operation or, in the alternative, transporting in connection with a conventional pallet after proper securing. A need has become evident, therefore, for an arrangement which positively serves drum transporting purposes.

In this latter regard, the invention presents a drum transporting arrangement characterized as a carrier or base which includes upstanding drum confining sections, typically opposed pairs, and legs and a center support which space the carrier from the floor or other receiving area. A notch is provided in each of the upstanding sections for receiving a band which surrounds the drum and, when tightened, aids in positive placement for transporting. The space provided beneath the carrier serves to receive the forks of a conventional lift truck introduced from various directions. In other words, the invention affords effective advantages in drum transporting, i.e. obviates the former awkward handling, either with or without the use of a convention pallet.

A better understanding of the present invention will become more apparent from the following description, taken in conjunction with the accompanying drawing, wherein FIG. 1 is a top plan view of a drum transporting arrangement in accordance with the teachings of the present invention, with the drum and encircling band being shown in phantom;

Figure 1:
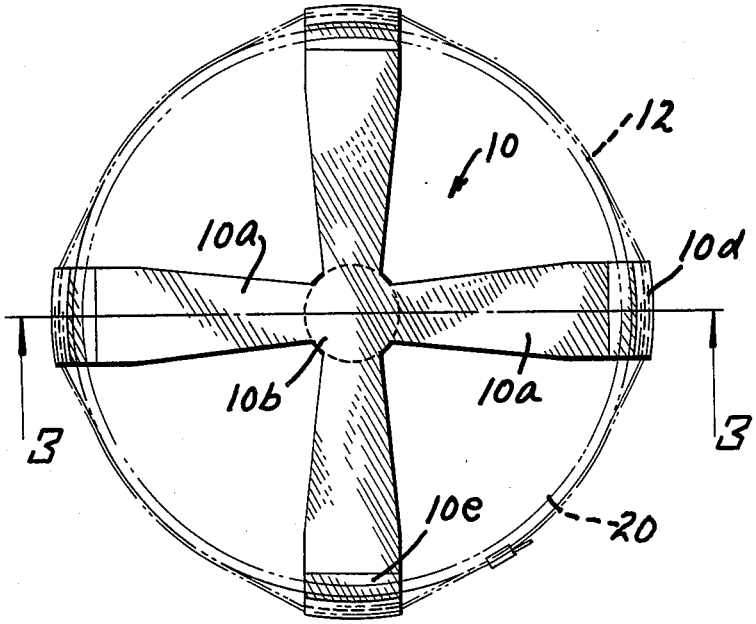
Figure 2:
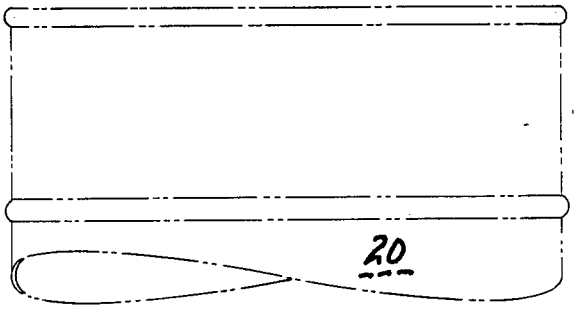
FIG. 2 is a selective view in side elevation of the arrangement.
Figure 3:
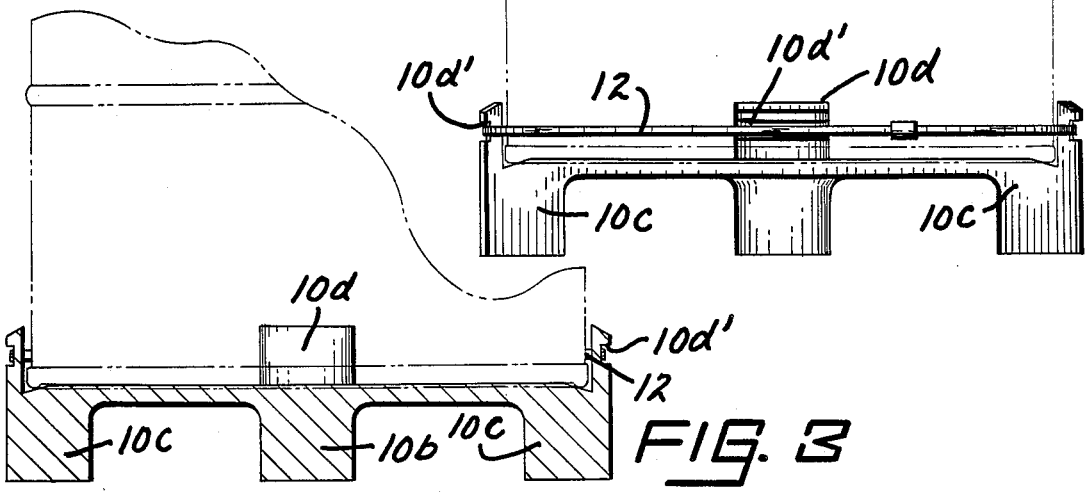
FIG. 3 is a view in vertical section, taken at line 3—3 on FIG. 1 and looking in the direction of the arrows, further detailing the invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the drum transporting arrangement presented by the invention is defined as a carrier or base 10 in the form of arms 10*a* extending from a center pedestal 10*b*. Each of the arms 10*a* presents, at its outer or free end, support leg 10*c*. Upstanding projections 10*d*, for drum 20 containment, are also disposed at the outer or free end of each arm 10*a*. A cutout portion 10*d'* is provided for receiving an adjustable securing band 12.

The base 10 further includes, at the end area of each arm 10*a* proximate the upstanding projection 10*d*, a downwardly angled portion 10*e* for added load receiving capabilities. The carrier or base 10, typically made from a high impact plastic resin, is unitary in form.

In use, the drum 20 is positioned on the base 10, i.e. on the top or upper surface of each arm 10*a* (and the center pedestal 10*b*), being confined between the upstanding projections 10*d*. The band 12 is then caused to encircle the drum 20, being tightened into a positive securing relationship. With the drum 20 on the base 10, the forks (not shown) of a conventional lift truck are readily received within the open space beneath the arms 10*a*, surrounding one of the legs 10*c*.

Thus, it should be evident that ready drum 20 transporting is achievable, where the forks of the lift truck can be introduced to lift the drum 20 and base 10 from various approach angles. As shown, and by way of example, the forklift truck can lift the combined drum and base or carrier from any of four directions.

It should be understood that the described drum transporting arrangement is susceptible to various changes within the spirit of the invention, including proportioning; the configuration of each arm; the number of the arms employed, where, for example, three would be workable; and, the like. Thus, the preceding should be considered illustrative and not as limiting the scope of the following claims:

I claim:

1. A drum transporting arrangement comprising an integral base including a surface supported center pedestal, a plurality of arms extending outwardly from said center pedestal, the upper surfaces of said arms and said center pedestal presenting a drum receiving area, upwardly extending projections disposed at the ends of each of said arms in a drum movement confining relationship, and legs extending downwardly at the ends of each of said arms, where said legs and said center pedestal are arranged to present a space beneath said drum receiving area for entry and lifting by a transporting mechanism in any of four directions, and where said upwardly extending projections are notched to receive a band encircling a drum in a selectively secured relationship.

2. The drum transporting arrangement of claim 1 where said arms include an outwardly and downwardly angled portion proximate said upwardly extending projection.

* * * * *